US010737500B2

(12) United States Patent
Hu et al.

(10) Patent No.: US 10,737,500 B2
(45) Date of Patent: Aug. 11, 2020

(54) METHOD FOR REUSING INK CARTRIDGE, SYSTEM OF REUSING INK CARTRIDGE, REUSED INK CARTRIDGE, AND READABLE STORAGE MEDIUM

(71) Applicant: HANGZHOU CHIPJET TECHNOLOGY CO., LTD., Hangzhou (CN)

(72) Inventors: Rongming Hu, Hangzhou (CN); Xinping Peng, Hangzhou (CN); Hechao Lu, Hangzhou (CN); Linbo Wang, Hangzhou (CN)

(73) Assignee: HANGZHOU CHIPJET TECHNOLOGY CO., LTD., Hangzhou (CN)

( * ) Notice: Subject to any disclaimer, the term of this patent is extended or adjusted under 35 U.S.C. 154(b) by 0 days.

(21) Appl. No.: 16/504,197

(22) Filed: Jul. 5, 2019

(65) Prior Publication Data

US 2020/0094569 A1 Mar. 26, 2020

Related U.S. Application Data

(63) Continuation of application No. PCT/CN2019/076019, filed on Feb. 25, 2019.

(30) Foreign Application Priority Data

Sep. 20, 2018 (CN) ..... 2018 1 1097022

(51) Int. Cl.

| | |
|---|---|
| ***B41J 2/175*** | (2006.01) |
| ***B41J 29/38*** | (2006.01) |
| ***G03G 21/18*** | (2006.01) |

(52) U.S. Cl.

CPC ..... *B41J 2/17546* (2013.01); *B41J 29/38* (2013.01); *G03G 21/1878* (2013.01); *B41J 2002/17569* (2013.01); *G03G 2221/1823* (2013.01)

(58) Field of Classification Search

CPC ..... B41J 2/17546; B41J 29/38; B41J 2002/17569; G03G 21/1878; G03G 2221/1823

See application file for complete search history.

(56) References Cited

U.S. PATENT DOCUMENTS

| | | | | |
|---|---|---|---|---|
| 6,431,685 | B1 * | 8/2002 | Misumi | B41J 2/04506 347/57 |
| 2009/0040260 | A1 * | 2/2009 | Anderson | B41J 2/0458 347/19 |
| 2017/0144463 | A1 * | 5/2017 | Kyoso | B41J 2/04543 |

FOREIGN PATENT DOCUMENTS

| | | | |
|---|---|---|---|
| CN | 204109559 | U | 1/2015 |
| CN | 105346256 | A | 2/2016 |

(Continued)

OTHER PUBLICATIONS

International Search Report of PCT/CN2019/076019.

*Primary Examiner* — Yaovi M Ameh

(57) ABSTRACT

The present disclosure discloses a method for reusing an ink cartridge, a system thereof, a readable storage medium and a reused ink cartridge, which belong to ink cartridge in printing field. The method includes detecting each of a plurality of heating elements in the ink cartridge, wherein the plurality of heating elements are located on both sides of nozzles of the ink cartridge; determining one of the plurality of heating elements which is not matched with a printer as a target heating element according to detecting result; and burning out the target heating element. Therefore, the target heating element will not be detected, the ink cartridge will (Continued)

match with the printer in new version, resulting in the ink cartridge can be reused and applied in the printer in new version.

11 Claims, 13 Drawing Sheets

(56) References Cited

FOREIGN PATENT DOCUMENTS

| | | | |
|---|---|---|---|
| CN | 105398224 | A | 3/2016 |
| CN | 104070824 | A | 4/2016 |
| CN | 106956516 | A | 7/2017 |

* cited by examiner

METHOD FOR REUSING INK CARTRIDGE, SYSTEM OF REUSING INK CARTRIDGE, REUSED INK CARTRIDGE, AND READABLE STORAGE MEDIUM

CROSS-REFERENCE TO RELATED APPLICATIONS

This application is a continuation of PCT patent application PCT/CN2019/076019 filed on Feb. 25, 2019, which claims all benefits accruing under 35 U.S.C. § 119 from China Patent Application No. 201811097022.9, filed on Sep. 20, 2018, in the State Intellectual Property Office of China, the content of which is hereby incorporated by reference.

TECHNICAL FIELD

The present disclosure relates to a method for reusing an ink cartridge, a system thereof, a readable storage medium and a reused ink cartridge.

BACKGROUND

In recent years, inkjet printing technology has become more and more mature, and the number of inkjet printing products and printing consumables are increasing. An ink cartridge is usually used as a disposable product, so a large number of ink cartridges are discarded causing environmental pollution and a waste of resources. With increasing public awareness on conservation of resources and environmental protection, reusing ink cartridges has gradually become a trend in printer development.

When the ink cartridge is used in a printer, nozzles of an inkjet head is generally controlled to eject ink by a plurality of heating elements. Due to fast updating speed of printers and ink cartridges, matching ink cartridges to different versions of printers becomes difficult. In general, new versions of printers and ink cartridges have a reduced number of heating elements. When a previous ink cartridge is used on a new printer, the new printers may detect the previous ink cartridge is not compatible and give an error message. Thus, the previous ink cartridge cannot be used on the new printer. As a result, a large number of the previous ink cartridges cannot be used even with ink refilling technology.

SUMMARY

The present application provides a method for reusing an ink cartridge, which can include the following steps: detecting a plurality of heating elements in the ink cartridge, wherein the plurality of heating elements are located on both sides of nozzles of the ink cartridge; determining one of the plurality of heating elements which is not matched or used with a printer as a target heating element according to a detecting result; and burning out the target heating element.

In the method of reusing the ink cartridge, each of the plurality of heating elements in the ink cartridge is detected; one of the plurality of heating elements not matched or used with the printer is determined as the target heating element and will be burned out. Therefore, the target heating element will not be detected, the ink cartridge will be compatible with the printer in new version, resulting in the ink cartridge can be reused and applied in the printer in new version.

In an embodiment, the step of burning out the target heating element further includes: turning on one end of the target heating element; and applying a driving signal to the other end of the target heating element.

In an embodiment, the step of turning on one end of the target heating element further includes: sending a target signal to the ink cartridge, and turning on a control tube of the ink cartridge according to the target signal in order to turn on one end of the target heating element. The step of applying the driving signal to the other end of the target heating element further includes: applying a high-voltage pulse signal to the other end of the target heating element.

In an embodiment, after the step of applying the driving signal to the other end of the target heating element the method further includes: applying a first detecting signal to the other end of the target heating element, receiving a first feedback signal of the other end of the target heating element, and judging if the target heating element is burned out or not according to the first feedback signal; if the target heating element is not burned out, repeating the step of applying the driving signal to the other end of the target heating element.

In an embodiment, the first feedback signal includes an electric potential of drive end of the target heating element. The step of judging if the target heating element is burned out or not according to the first feedback signal further includes: if the electric potential of drive end of the target heating element is the same as an electric potential of the first detecting signal, judging that the target heating element is burned out.

In an embodiment, the detecting result includes state information of each of the plurality of heating elements. The step of determining one of the plurality of heating elements as the target heating element according to the detecting result further includes: obtaining state information of preset heating elements, wherein the preset heating elements matches and are used and compatible with the printer; determining one of the plurality of heating elements as the target heating element according to the state information of each of the plurality of heating elements and the state information of preset heating elements.

In an embodiment, the state information of each of the plurality of heating elements is detected by following steps: turning on one end of one of the plurality of heating elements, and applying a second detecting signal to the other end of the one of the plurality of heating elements; and obtaining a second feedback signal of the one of the plurality of heating elements, and obtaining the state information of each of the plurality of heating elements according to the second feedback signal.

In an embodiment, the step of turning on one end of the one of the plurality of heating elements includes following steps: sending a selected signal to the ink cartridge, turning on a control tube of the ink cartridge according to the selected signal in order to turn on one end of the one of the plurality of heating elements. The step of applying a second detecting signal to the other end of the one of the plurality of heating elements includes following steps: applying a preset low-voltage signal to the other end of the one of the plurality of heating elements.

The present disclosure further provides a system of reusing an ink cartridge, wherein including: a detecting unit configured for detecting each of a plurality of heating elements in the ink cartridge, wherein the plurality of heating elements are located on both sides of nozzles of the ink cartridge; an analyzing unit configured for determining one of the plurality of heating elements not matched or used with a printer as a target heating element according to a detecting result; and an operating unit configured for burning out the target heating element.

In the system of reusing the ink cartridge, each of the plurality of heating elements in the ink cartridge is detected; one of the plurality of heating elements not matched or used with the printer is determined as the target heating element and will be burned out. Therefore, the target heating element will not be detected, the ink cartridge will match with the printer in new version, resulting in the ink cartridge can be reused and applied in the printer in new version.

In an embodiment, the element operating unit can send a target signal to the ink cartridge, and turn on a control tube of the ink cartridge according to the target signal in order to turn on one end of the target heating element.

The element operating unit can applying a high-voltage pulse signal to the other end of the target heating element.

In an embodiment, the element operating unit can apply a first detecting signal to the other end of the target heating element, receive a first feedback signal of the other end of the target heating element, and judge if the target heating element is burned out or not according to the first feedback signal.

In an embodiment, the first feedback signal can include an electric potential of drive end of the target heating element. If the electric potential of drive end of the target heating element is the same as an electric potential of the first detecting signal, judging that the target heating element is burned out.

In an embodiment, the detecting result can include state information of each of the plurality of heating elements.

In an embodiment, the element analyzing unit can obtain state information of preset heating elements, wherein the preset heating elements matches and are used and compatible with the printer.

In an embodiment, the element detecting unit can turn on one end of the one of the plurality of heating elements, apply a second detecting signal to the other end of the one of the plurality of heating elements, and obtain the state information of each of the plurality of heating elements according to the second feedback signal.

In an embodiment, the element detecting unit can send a selected signal to the ink cartridge, turning on a control tube of the ink cartridge according to the selected signal in order to turn on one end of the one of the plurality of heating elements.

The element detecting unit can apply a preset low-voltage signal to the other end of the one of the plurality of heating elements.

In an embodiment, the second feedback signal can include the electric potential of the drive end of the target heating element. If the electric potential of the drive end of one of the plurality of heating elements is different from an electric potential of the second detecting signal, the element detecting unit can judge that the one of the plurality of heating elements is normal.

The present disclosure further provides a readable storage medium including an executable program. The executable program is executed by a processor to perform the steps of the method for reusing the ink cartridge.

In the readable storage medium can perform the following steps of the method for reusing the ink cartridge by the executable program. Each of the plurality of heating elements in the ink cartridge is detected. One of the plurality of heating elements not matched or used with the printer is determined as the target heating element and will be burned out. Therefore, the target heating element will not be detected, the ink cartridge will match and now can be used with the printer in the new version.

The present disclosure further provides a reused ink cartridge including a plurality of heating elements, the plurality of heating elements are located on both sides of nozzles of the reused ink cartridge; the plurality of heating elements include a target heating element not matched or used with a new printer, wherein the target heating element is burned out.

In an embodiment, the reused ink cartridge further includes a plurality of control tubes and a heating element controller connected to the plurality of control tubes; each of the plurality of heating elements is correspondingly connected to one of the plurality of control tubes; the heating element controller is configured for receiving a target signal, and turning on one of the plurality of control tubes correspondingly, in order to turn on one end of the target heating element.

The reused ink cartridge includes the plurality of heating elements located on sides of nozzles of the reused ink cartridge. The plurality of heating elements includes a target heating element not matched or used with a printer and burned out, that is, the target heating element cannot be used normally. Therefore, when the reused ink cartridge is applied in the printer in new version, the target heating element will not be detected, and the ink cartridge will match with the printer in new version. That is, the ink cartridge can be reused and applied in the printer in new version.

DETAILED DESCRIPTION

The present disclosure will be further described in detail below with reference to the drawings and specific embodiments, in order to better understand the objective, the technical solution and the advantage of the present disclosure. It should be understood that the specific embodiments described herein are merely illustrative and are not intended to limit the scope of the disclosure.

It should be noted that the term "first" or "second" according to the embodiment of the present disclosure is merely a similar object, and does not represent a specific ordering for the object. It can be understood that the "first" or "second" can be interchanged in order when permitted. It should be understood that the "first" or "second" distinguished objects may be interchanged as appropriate to enable embodiments of the present disclosure described herein to be implemented in a sequence other than those illustrated or described herein.

Figure 1:
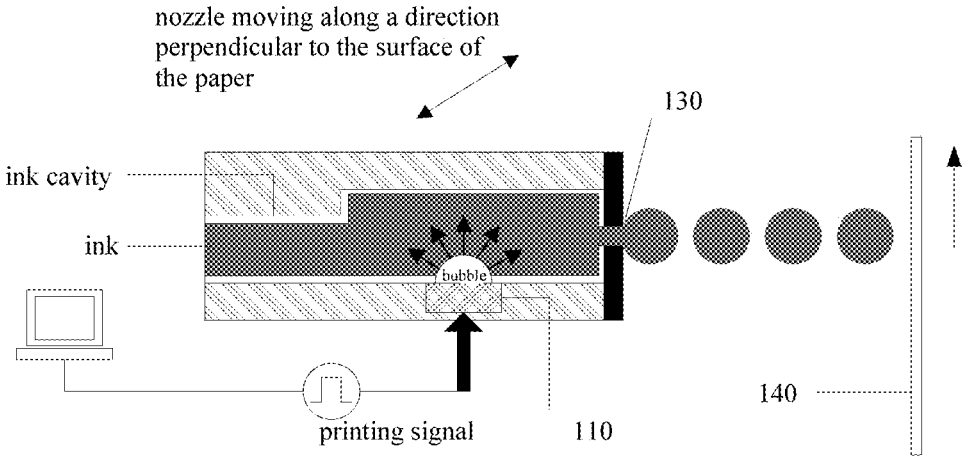
FIG. 1 is a schematic view of working principle of an ink cartridge in an embodiment of the present disclosure.

A reused ink cartridge in the present disclosure can be applied in an embodiment of FIG. 1. A printing method called the "hot bubble" method includes the following: an inkjet head is rapidly heated by a heating element 110; ink in the inkjet head is vaporized to generate bubbles, the bubbles resulting in the ink being sprayed; and the ink is ejected from an ink nozzle 130 onto paper 140 in a speed of 3,000 to 6,200 points per second. When the nozzle 130 is close to the paper 140, a desired pattern can be accurately formed on the paper 140.

Figure 2:
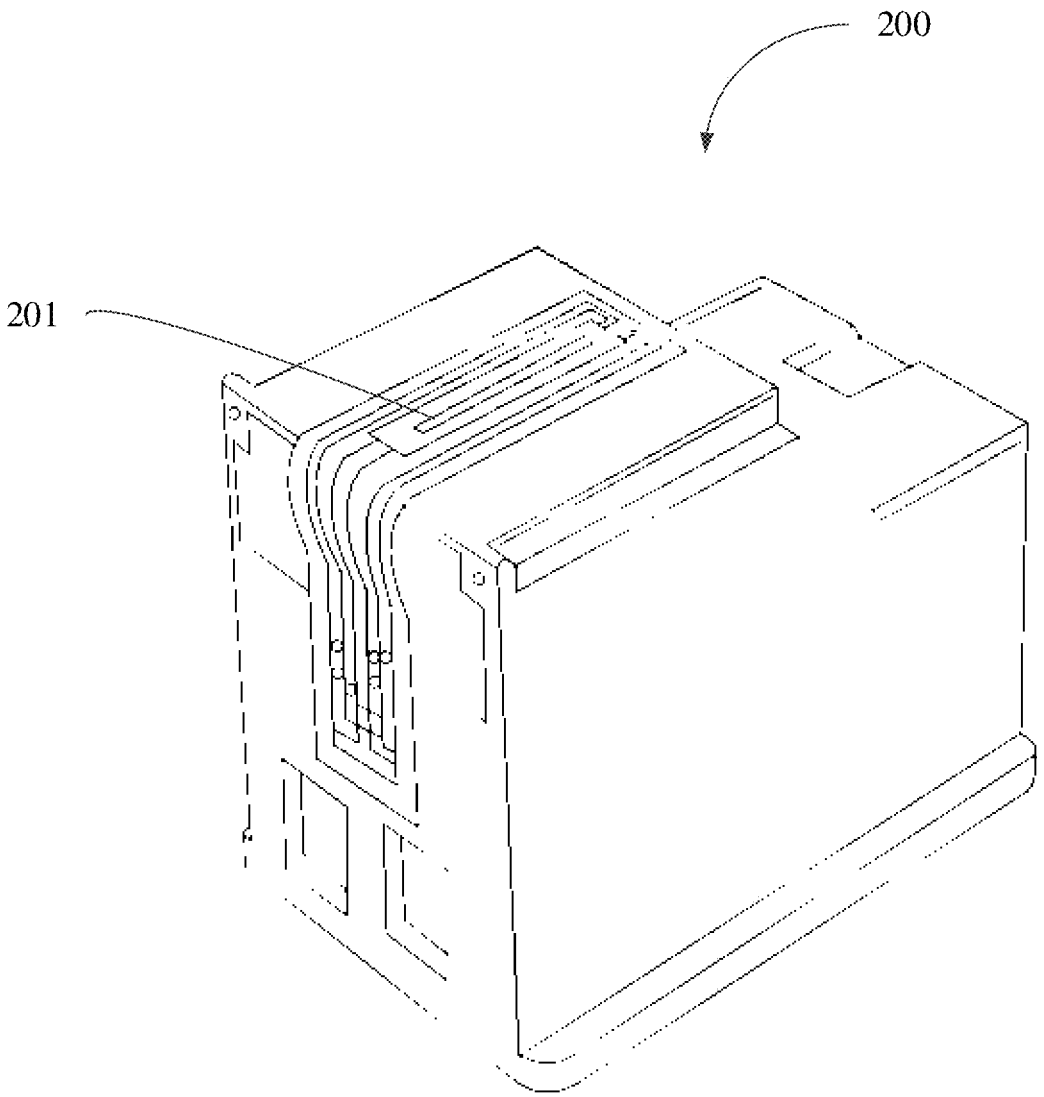
FIG. 2 is a schematic view of an ink cartridge with nozzles in another embodiment.

Referring to FIG. 2, a structure of an ink cartridge 200 with nozzles 201 is provided. A printer OEM manufacturer (Original Equipment Manufacturer) may design an ink cartridge with a plurality of heating elements (not shown) to realize printing complex graphics. The number of the plurality of heating elements can be labeled as "N".

Figure 3:
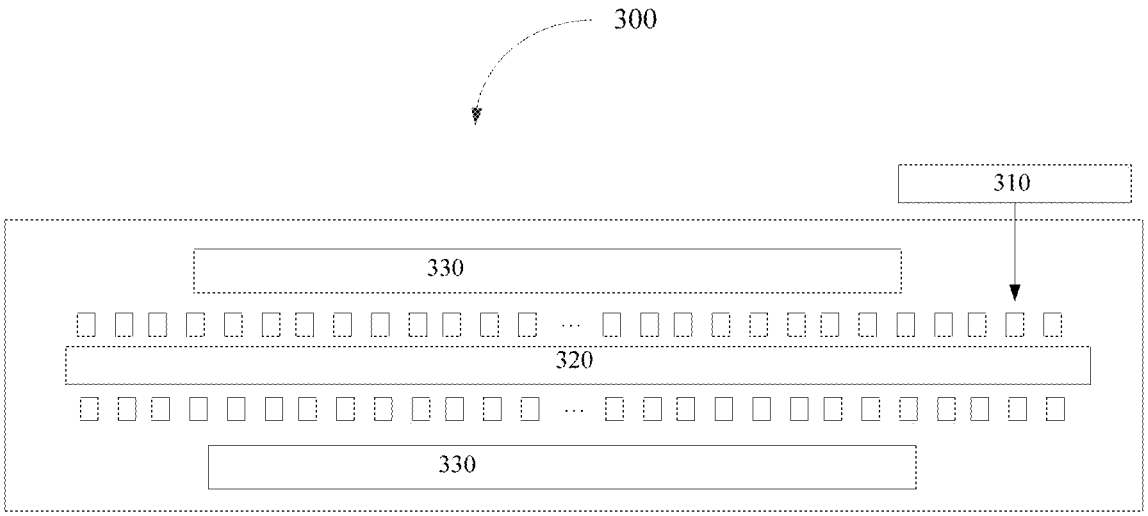
FIG. 3 is a schematic view of distribution of a plurality of heating elements of an ink cartridge in another embodiment.

As shown in FIG. 3, the plurality of heating elements 310 of the ink cartridge 300 is distributed on both sides of the one or more nozzles 320, and heating element control logic 330 on both sides of the heating elements 310. When the ink cartridge 300 moves in the printer, some of the heating elements of the plurality of heating elements 310 will be selected or not selected by the heating element control logic 330, and a desired pattern can be smoothly printed by the printer. The number of spraying points is determined by the number of heating elements 310, and the more effective spraying points, the better the printing quality.

When the OEM manufacturer makes new ink cartridges and printers, in order to distinguish from older, previously produced ink cartridges, the number of heating elements of the new ink cartridges has decreased. This has no effect on the printing quality. However, when applying the previously produced ink cartridge to a new printer, the new printer can detect one or more redundant heating elements or heating elements which do not correspond to the new printer, indicating that the previous ink cartridge is incompatible with the new printer (i.e., does not match the new printer), and produces an error message, which does not allow the new printer to use the previous ink cartridge.

In an ink cartridge market, there are a large number of used ink cartridges in a previous version. Recycling these used ink cartridges can greatly improve the environment and reduce energy use, but since the difference number of heating elements designed by the OEM manufacturer, these used ink cartridges in the previous version have been very difficult to recycle.

Figure 4:
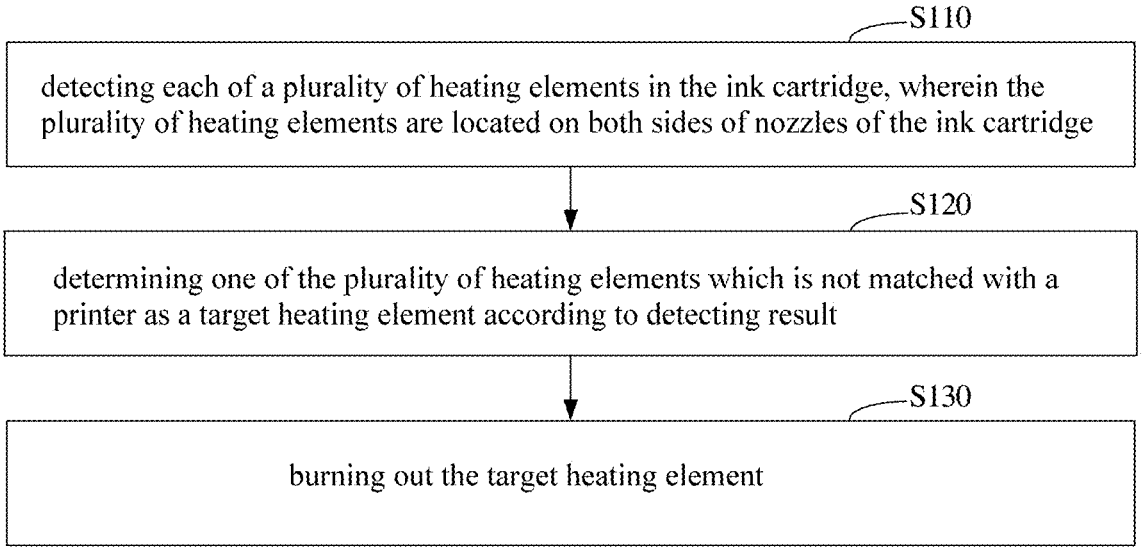
FIG. 4 is a flow chart of a method for reusing an ink cartridge in another embodiment.

Referring to FIG. 4, a method for reusing an ink cartridge in an embodiment is provided. The method can include the following:

S110, detecting each of a plurality of heating elements in the ink cartridge, wherein the plurality of heating elements is located on both sides of nozzles of the ink cartridge.

In step S110, the purpose of detecting each of the plurality of heating elements in the ink cartridge is to obtain the information of each of the plurality of heating elements. The plurality of heating elements can be located on two sides of nozzles and configured for spraying ink. The number of nozzles can be one or more.

S120, determining the one or more of the plurality of heating elements, which do not match or are compatible with a new printer, such as the one or more heating elements do not correspond to the new printer or the new printer detects the one or more heating elements as being one or more redundant heating elements, as a target heating element.

S130, burning out the target heating element.

In step S130, after the target heating element is burned out, the burned out target heating element will not be detected and selected by the printer, thereby preventing the printer from rejecting the ink cartridge as incompatible.

In this embodiment, each of the plurality of heating elements on both sides of the nozzles in the ink cartridge is detected. One or more of the plurality of heating elements, which are not matched or compatible with the new printer, is determined as the target heating element and will be burned out. Therefore, the target heating element will not be detected and the ink cartridge will now be usable with the printer.

It should be noted that the function of the plurality of heating elements is to excite ink to spray. The plurality of heating elements can be various devices to generate heat controlled by an electrical signal, such as a thermistor or the like.

Furthermore, the step of burning out the target heating element further includes:

turning on one end of the target heating element; and applying a driving signal to the other end of the target heating element.

In this embodiment, the one end of the target heating element can be turned on, and the driving signal is applied to the other end of the target heating element. Under the action of the driving signal, the target heating element will be heated rapidly until burned out and damaged. In the burned out and damaged state, the target heating element will not have the heating function, and the printer will not detect the target heating element when the ink cartridge is to be operated, so that the ink cartridge can be used normally in the printer.

Furthermore, the step of turning on one end of the target heating element further includes:

sending a target signal to the ink cartridge, and turning on a control tube of the ink cartridge according to the target signal in order to turn on one end of the target heating element.

The step of applying the driving signal to the other end of the target heating element further includes:

applying a high-voltage pulse signal to the other end of the target heating element.

In this embodiment, one end of the target heating element is turned on by the control tube. When the control tube is turned on, one end of the target heating element is turned on. The control tube can be turned on through the target signal, so that the state of the target heating element is controllable, and the target heating element can be selected by the target signal. In addition, a high-voltage pulse signal can be applied to the other end of the target heating element. Since the high-voltage pulse signal is an instantaneous high-voltage signal, it can prevent the heating element from being heated rapidly and ink in the ink cartridge from spraying, and burn out the target heating element at the same time.

Furthermore, the target signal can be sent to the control tube of the ink cartridge through a level switch circuit.

In another embodiment, after the step of applying the driving signal to the other end of the target heating element, the method further includes:

applying a first detecting signal to the other end of the target heating element, obtaining a first feedback signal of the other end of the target heating element, and judging if the target heating element is burned out or not according to the first feedback signal;

if the target heating element is not burned out, repeating the step of applying the driving signal to the other end of the target heating element.

In this embodiment, after the driving signal is applied to the other end of the target heating element, the target heating element will be burned out for a period of time. The first detecting signal can be applied after the driving signal is applied. The first feedback signal can be used to determine whether the target heating element is burned out or not. If the target heating element is not burned out according to the first feedback signal, it indicates that time of applying the driving signal may be not enough. The driving signal can be continuously applied to the other end of the target heating element until the target heating element is burned out, so that the target heating element can be finally burned out and match (e.g., compatible) with the printer.

Furthermore, the first detecting signal can be a preset low-voltage signal.

Furthermore, the first feedback signal can include an electric potential of drive end of the target heating element. The step of judging if the target heating element is burned out or not according to the first feedback signal further includes:

if the electric potential of drive end of the target heating element is the same as an electric potential of the first detecting signal, judging that the target heating element is burned out.

After the target heating element is determined, the first detecting signal is applied on the target heating element. In the situation of the target heating element connecting normally, the target heating element will be turned on, and the electric potential of drive end of the target heating element will change and be different from the electric potential of the first detecting signal. If the electric potential of drive end of the target heating element is the same as the electric potential of the first detecting signal, it means the target heating element is damaged or connected in fault, and it also means the target heating element is burned out. In this way, it can detect whether the target heating element is burned out or not.

In detail, a driving end of each of the plurality of heating elements can be connected to a power source. When the target heating element is turned on, the electric potential of drive end of the target heating element will be decreased and different from the electric potential of the first detecting signal. When the target heating element is damaged, the electric potential of drive end of the target heating element will not be declined and the same as the electric potential of the first detecting signal. According to the electric potential of the drive end of the target heating element, it can be judged whether the target heating element is normal or not. The number of the target heating element can be multiple and sequentially burned and detected, since only one target heating element can be selected each time. The driving end can be the other end of the target heating element.

The detecting result can include state information of each of the plurality of heating elements.

In another embodiment, the step of determining one of the plurality of heating elements as the target heating element according to the detecting result further includes:

obtaining state information of preset heating elements, wherein the preset heating elements matches with the printer;

determining one of the plurality of heating elements as the target heating element according to the state information of each of the plurality of heating elements and the state information of preset heating elements.

In this embodiment, when the heating element is detected, the state information of each of the plurality of heating elements can be obtained. The state information of the preset heating elements matched with the printer is obtained. By comparing the state information of each of the plurality of heating elements to the state information of the preset heating elements, the target heating element can be quickly determined.

For example, if N heating elements in the ink cartridge are detected in a normal working state, there are only M heating elements which are needed and matched with the printer in the ink cartridge, wherein M is less than N. Then it can be determined that the (N-M) heating elements in the ink cartridge are the target heating elements.

In another embodiment, the state information of each of the plurality of heating elements is detected by following steps:

turning on one end of one of the plurality of heating elements, and applying a second detecting signal to the other end of the one of the plurality of heating elements;

obtaining a second feedback signal of the one of the plurality of heating elements, and obtaining the state information of each of the plurality of heating elements according to the second feedback signal.

In the embodiment, when detecting the heating elements of the ink cartridge, one end of one of the heating elements can be turned on, and the other end of one of the heating elements may be applied by the second detecting signal. If the target heating element starts to work under the action of the second detecting signal, the state information of each of the plurality of heating elements can be obtained according to the second feedback signal, and the detection result can be quickly obtained.

In another embodiment, the step of turning on one end of the one of the plurality of heating elements can include the following steps:

sending a selected signal to the ink cartridge, turning on a control tube of the ink cartridge according to the selected signal in order to turn on one end of the one of the plurality of heating elements;

The step of applying a second detecting signal to the other end of the one of the plurality of heating elements can include the following steps:

applying a preset low-voltage signal to the other end of the one of the plurality of heating elements.

In this embodiment, the one end of the one of the plurality of heating elements is electrically connected through the control tube. When the control tube is turned on, one end of the one of the plurality of heating elements is electrically connected. The control tube can be controlled by the selected signal, so the state of the heating elements is controllable, and the heating elements to be detected can be selected by the selected signal. In addition, a preset low-voltage signal is applied to the other end of the one of the plurality of heating elements, and the low-voltage signal can prevent the heating elements from heating rapidly and causing the ink spraying, and at the same time, detecting the plurality of heating elements can be completed. The second detecting signal can be a preset low-voltage signal.

Furthermore, the second feedback signal can include the electric potential of the drive end of the target heating element. The step of obtaining the state information of each of the plurality of heating elements according to the second feedback signal further includes:

if the electric potential of the drive end of one of the plurality of heating elements is different from an electric potential of the second detecting signal, judging that the one of the plurality of heating elements is normal.

After the one of the plurality of heating elements is applied by the second detecting signal, if the electric potential of the drive end of the one of the plurality of heating elements is changed, it means the one of the plurality of heating elements is connected normally and can be turned on. If the electric potential of drive end of the one of the plurality of heating elements is the same as the electric potential of the second detecting signal, it means the one of the plurality of heating elements is damaged or connected in fault. In this way, it can detect the state information of each of the plurality of heating elements.

In detail, the driving end of each of the plurality of heating elements can be connected to the power source. When one of the plurality of heating elements is turned on, the electric potential of the drive end of the plurality of heating elements will be declined and different from the electric potential of the second detecting signal. When the target heating element is damaged, the electric potential of drive end of the one of the plurality of heating elements will not be declined and the same as the electric potential of the second detecting signal. According to the electric potential of the drive end of the one of the plurality of heating elements, it can be judged whether the one of the plurality of heating elements is normal or not. The plurality of heating elements can be sequentially detected, since only one heating element can be selected each time. The driving end can be the other end of the one of the plurality of heating elements.

In practical application, in order to detect the quality of the heating elements in the ink cartridge, the quality and type of the ink cartridge will be firstly detected when the printer is just powered on, which is designed by the OEM manufacturer. When the printer sends a detecting signal to the heating elements, the heating element control logic will select a corresponding heating element, and the heating elements gives a corresponding feedback signal to the printer. When the feedback signal is detected, it indicates there is a heating element and the heating element works well. When the feedback signal is not detected, it indicates there is no heating element or the heating element is damaged. In this way, the printer can detect the quality of the heating elements in the ink cartridge, thereby ensuring the quality of printing.

Figure 5:
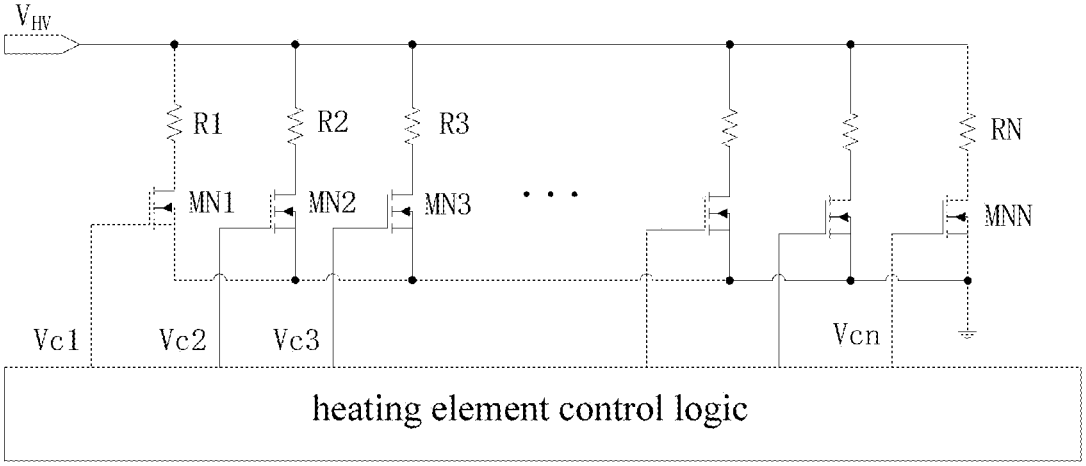
FIG. 5 is a schematic view showing hardware of a plurality of heating elements in an ink cartridge in an embodiment.

Referring to FIG. 5, the heating elements in the ink cartridge can be selected by a heating element control logic. The heating element control logic outputs N control signals Vcn, and the control signal Vcn is connected to a gate electrode of a control tube MNN. A source electrode and a substrate of the control tube MNN are grounded. A drain electrode of the control tube MNN is connected to the negative terminal of a heating element RN. A positive terminal of the heating element RN is connected to a high-voltage signal $V_{HV}$, and the ink cartridge includes N sets of the heating elements.

In a printing process, when a voltage Vcn of the gate electrode of the control tube MNN is controlled to increase by the heating element control logic, the control tube MNN will be turned on. The high voltage signal $V_{HV}$ will up to 20-30V, causing the heating element RN to rapidly be heated. Therefore, air bubbles will be generated in the nozzle of the ink cartridge, thereby causing ink to be sprayed from the ink cartridge. When Vcn is reduced, the control tube MNN will not turn on, and the heating element RN will not be heated, so that the ink is not sprayed. In a process of detecting whether the heating element works or not, the heating elements in the ink cartridge will be sequentially selected. When the gate voltage Vcn of the control tube MNN is controlled to increase the heating element control logic, the control tube MNN will be turned on. Then the $V_{HV}$ only gives a low voltage signal of 3V. The heating element will be not heated rapidly, and the ink cartridge will not spray ink. However, the voltage at the $V_{HV}$ terminal will be reduced due to the heating element. When the printer detects a low feedback signal, it indicates that the heating element exists and has no damage. Correspondingly, when the printer selects the corresponding heating element through the heating element control logic and the feedback signal is high, it indicates that the heating element does not exist or is damaged.

The number of the heating elements of the ink cartridge in the new version is less than the number of the heating elements of ink cartridge in an older previous version, and the new printer will detect whether the ink cartridge have the heating elements of the ink cartridge in the previous version in the corresponding positions. When the new printer detects the heating elements of the ink cartridge in the previous version, the ink cartridge error message will be prompted, and the ink cartridge in the previous version will not be used in the new printer and discarded, resulting in a large environmental pollution.

Figure 6:
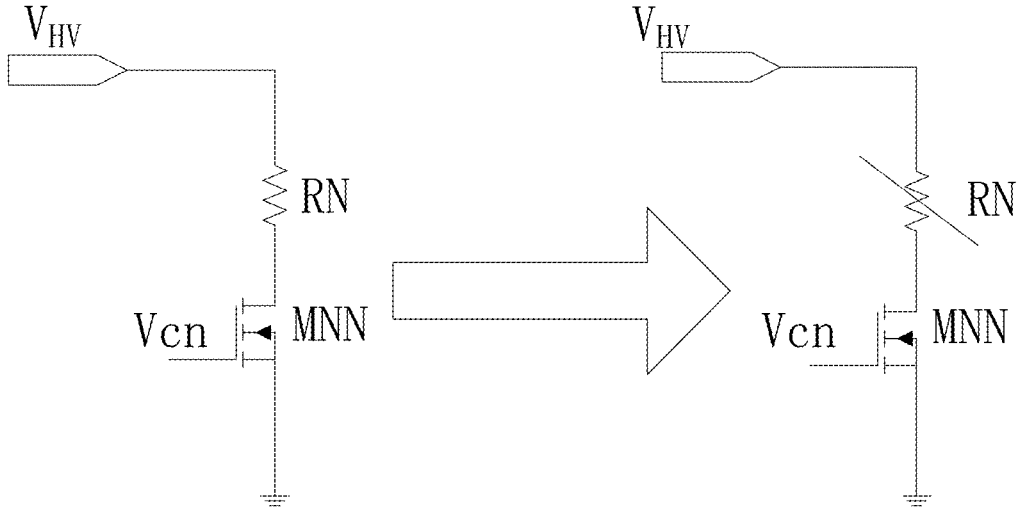
FIG. 6 is a schematic view showing a step of burning out the target heating element in an embodiment.

Referring to FIG. 6, the printer will detect the heating elements. If the ink cartridge in new version has fewer heating elements than the ink cartridge in the previous version. The excessive heating elements will be burned out in order to match with the new printer. In FIG. 6, a slash is added to the heating element RN to indicate that the heating element is burned out.

Figure 7:
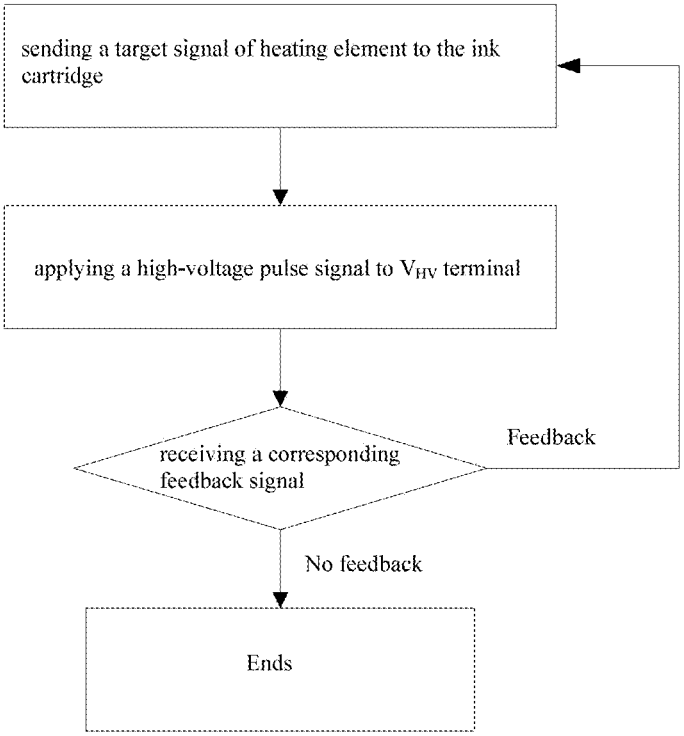
FIG. 7 is a flow chart showing a step of burning out the target heating element in an embodiment.

By externally transmitting the heating element selection signal, the high-voltage signal is frequently applied to the $V_{HV}$ terminal to burn out the heating element RN. Thereby when the Vcn is selected, the current path between the MNN and the input signal $V_{HV}$ is broken because the heating element RN is burned out. When detecting the heating element, the burned out heating element will not be detected, resulting in matching with the printer. The process can be as shown in FIG. 7.

Firstly, a selected signal is sent to the ink cartridge, the high-voltage pulse signal is inputted to the $V_{HV}$ terminal, and then the feedback signal is correspondingly detected. When a reduced feedback signal generated after the high-voltage pulse signal is received, it indicates that the heating elements still work and are not broken. It is necessary to resend the selected signal to the heating elements, and the high-voltage pulse signal is inputted to the $V_{HV}$ terminal until no reduced feedback signal is received, and the burn out process for the heating element will end.

Figure 8:
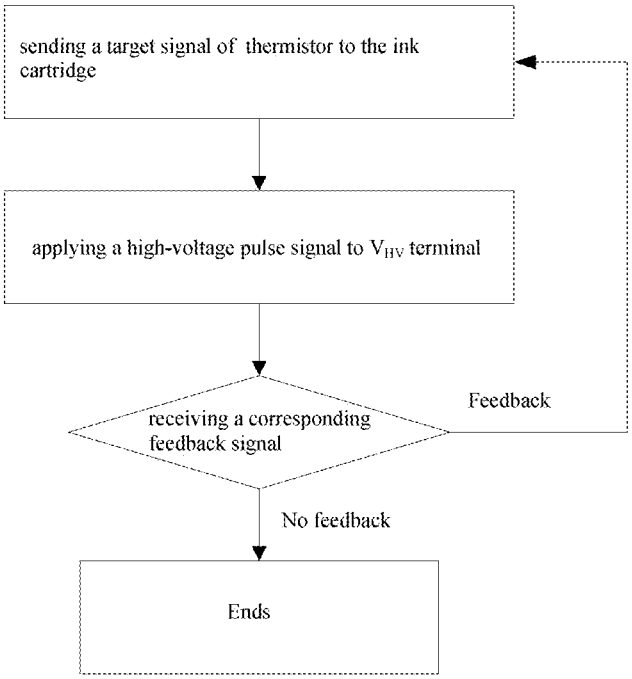
FIG. 8 is another flow chart showing a step of burning out the target heating element in another embodiment.

Furthermore, after the corresponding feedback signal is received, the target signal will not be sent and only the high-voltage pulse signal needs to be sent to the $V_{HV}$ repeatedly until no corresponding reduced feedback signal is detected, as shown in the FIG. 8.

After burning out, the heat elements are permanently broken. When applied in the new printer, the broken heat elements will not be detected, so that the ink cartridge can be reused and applied in the new printer.

According to the above method for reusing the ink cartridge, the present disclosure further provides a system of reusing an ink cartridge, which will be described in detail below.

Figure 9:
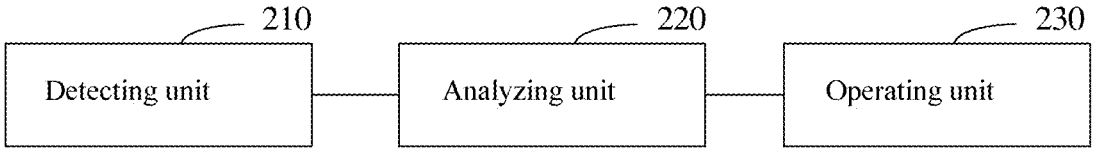
FIG. 9 is a schematic view of a system of reusing an ink cartridge in an embodiment.

Referring to FIG. 9, the system of reusing an ink cartridge can be showed. The system includes:

a detecting unit 210 configured for detecting each of a plurality of heating elements in the ink cartridge, wherein the plurality of heating elements are located on both sides of nozzles of the ink cartridge;

an analyzing unit 220 configured for determining one of the plurality of heating elements not matched with a printer as a target heating element according to a detecting result; and an operating unit 230 configured for burning out the target heating element.

In the system of reusing the ink cartridge, the detecting unit can detect each of the plurality of heating elements in the ink cartridge. The analyzing unit can determine one of the plurality of heating elements not matched with the printer as the target heating element according to the detecting result. The operating unit will burn out the target heating element. Therefore, the target heating element will not be detected, the ink cartridge will match with the printer in new version, resulting in the ink cartridge can be reused and applied in the printer in new version.

In one embodiment, the operating unit 230 can turn on one end of the target heating element and apply a driving signal to the other end of the target heating element.

In one embodiment, the operating unit 230 can send a target signal to the ink cartridge, and a control tube of the ink cartridge is turned on according to the target signal in order to turn on one end of the target heating element.

A high-voltage pulse signal can be applied to the other end of the target heating element.

In one embodiment, the operating unit 230 can apply a first detecting signal to the other end of the target heating element, receive a first feedback signal of the other end of the target heating element, and judge if the target heating element is burned out or not according to the first feedback signal. If the target heating element is not burned out, the step of applying the driving signal to the other end of the target heating element will be repeated.

In one embodiment, the first feedback signal can include an electric potential of drive end of the target heating element. If the electric potential of drive end of the target heating element is the same as an electric potential of the first detecting signal, the operating unit 230 will judge that the target heating element is burned out.

In one embodiment, the detecting result can include state information of each of the plurality of heating elements.

The analyzing unit 220 can obtains state information of preset heating elements matched with the printer, and determine one of the plurality of heating elements as the target heating element according to the state information of each of the plurality of heating elements and the state information of preset heating elements.

In one embodiment, the detecting unit 210 can turn on one end of one of the plurality of heating elements, and apply a second detecting signal to the other end of the one of the plurality of heating elements; and obtain a second feedback signal of the one of the plurality of heating elements, and obtaining the state information of each of the plurality of heating elements according to the second feedback signal.

In one embodiment, the element detecting unit 210 can send a selected signal to the ink cartridge, turning on a control tube of the ink cartridge according to the selected signal in order to turn on one end of the one of the plurality of heating elements.

The detecting unit 210 can apply a preset low-voltage signal to the other end of the one of the plurality of heating elements.

In one embodiment, the second feedback signal includes an electric potential of drive end of the one of the plurality of heating elements. If the electric potential of drive end of the one of the plurality of heating elements is different from the second detecting signal, the detecting unit 210 will judge the one of the plurality of heating elements is normal.

The system of reusing the ink cartridge in present disclosure can be corresponding to the method for reusing the ink cartridge, and the technical features disclosed in the embodiments of the methods for reusing the ink cartridge can be included in the embodiments of the system of reusing the ink cartridge.

Based on the method for reusing the ink cartridge, the present disclosure further provides a readable storage medium and a reused ink cartridge.

A readable storage medium can include an executable program. The executable program can be executed by a processor to perform the steps of the method for reusing the ink cartridge.

In the readable storage medium can perform the following steps of the method for reusing the ink cartridge by the executable program. Each of the plurality of heating elements in the ink cartridge is detected. One of the plurality of heating elements not matched with the printer is determined as the target heating element and will be burned out. Therefore, the target heating element will not be detected, the ink cartridge will match with the printer in new version, resulting in the ink cartridge can be reused and applied in the printer in new version.

One skilled in the art can understand that all or part of the process in the above embodiments can be completed by a computer program to instruct related hardware, and the program can be stored in a non-volatile computer readable storage medium. In the embodiment, the program may be stored in a storage medium of the computer system and executed by at least one processor in the computer system to implement steps of an embodiment including a method of reusing the ink cartridge as described. The storage medium may be a magnetic disk, an optical disk, a read-only memory (ROM), or a random access memory (RAM).

Figure 10:
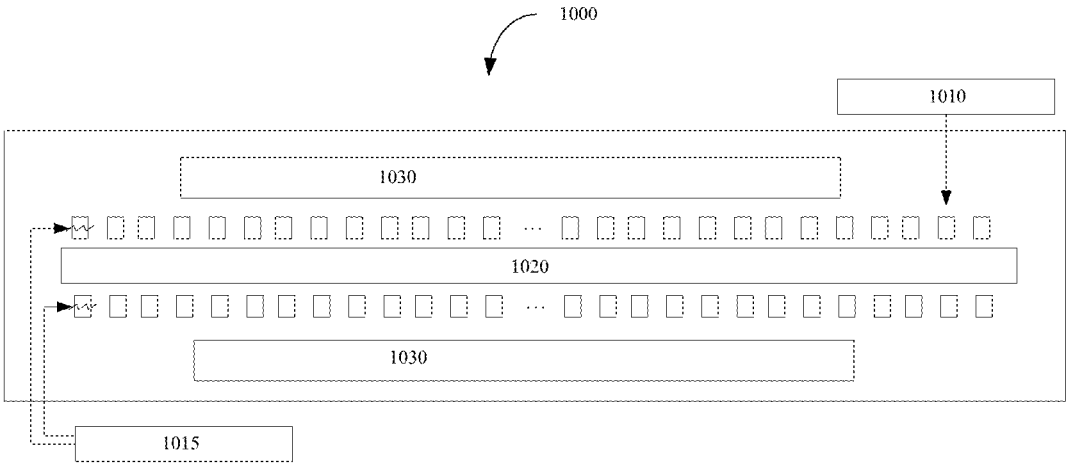
FIG. 10 is a schematic view of distribution of a plurality of heating elements of a reused ink cartridge in an embodiment.

Referring to FIG. 10, a reused ink cartridge 1000 is provided. The reused ink cartridge 1000 can include a plurality of heating elements 1010. The plurality of heating elements 1010 can be located on both sides of nozzles 1020 of the reused ink cartridge 1000.

The plurality of heating elements 1010 can include a target heating element 1015 not matched with a printer, wherein the target heating element 1015 is burned out.

It should be noted that the plurality of heating elements 1010 can be located on both sides of nozzles 1020 of the reused ink cartridge 1000. The number of nozzles 1020 can be one or more. The function of the plurality of heating elements 1010 is to excite ink to spray. The plurality of heating elements 1010 can be various devices to generate heat controlled by an electrical signal, such as a thermistor or the like. One of the plurality of heating elements 1010 which is not matched or compatible with the printer is determined as the target heating element 1015 and will be burned out. Therefore, the target heating element 1015 will not be detected, and the ink cartridge 1000 will now match or is now compatible with the printer, resulting in a reusable ink cartridge that can be applied in the printer.

The reused ink cartridge 1000 includes the plurality of heating elements 1010 located on sides of nozzles 1020 of the reused ink cartridge 1000. The plurality of heating elements 1010 include a target heating element 1015 not matched with the printer and burned out, that is, the target heating element 1015 cannot be used normally. Therefore, when the reused ink cartridge is applied in the printer with a new version, the target heating element 1015 will not be detected, and the ink cartridge will match with the new printer. That is, the ink cartridge can be reused and applied in the new printer.

Figure 11:
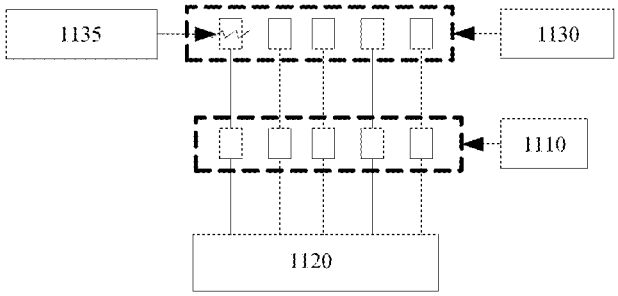
FIG. 11 is a schematic view of a reused ink cartridge in an embodiment

Referring to FIG. 11, in one embodiment, the reused ink cartridge can further include a plurality of control tubes 1110 and a heating element controller 1120.

Each of the plurality of heating elements 1130 can be correspondingly connected to one of the plurality of control tubes 1110. The heating element controller 1120 can be connected to the plurality of control tubes 1110.

The heating element controller 1120 is configured for receiving a target signal, and turning on one of the plurality of control tubes 1110 correspondingly, in order to turn on one end of the target heating element 1135.

In this embodiment, the reused ink cartridge includes the plurality of control tubes 1110 and a heating element controller 1120. The heating element controller 1120 can receive the target signal and control station of the plurality of control tubes 1110, in order to select and burn out the target heating element 1135. One end of the target heating element 1135 can be turned on and the other end of the target heating element 1135 can be drive by a driving signal to burn out and by a detecting signal to detect whether the target heating element 1135 has been burned out or not.

In practical application, in order to detect the quality of the heating elements in the ink cartridge, the quality and type of the ink cartridge will firstly detect when the printer is just powered on, which is designed by the OEM manufacturer. When the printer sends a detecting signal to the heating elements, the heating element control logic will select one or more corresponding heating elements, and the heating elements gives a corresponding feedback signal to the printer. When the feedback signal is detected, it indicates there is a heating element and the heating element works well. When the feedback signal is not detected, it indicates there is no heating element or the heating element is damaged. In this way, the printer can detect the quality of the heating elements in the ink cartridge, thereby ensuring the quality of printing.

Figure 12:
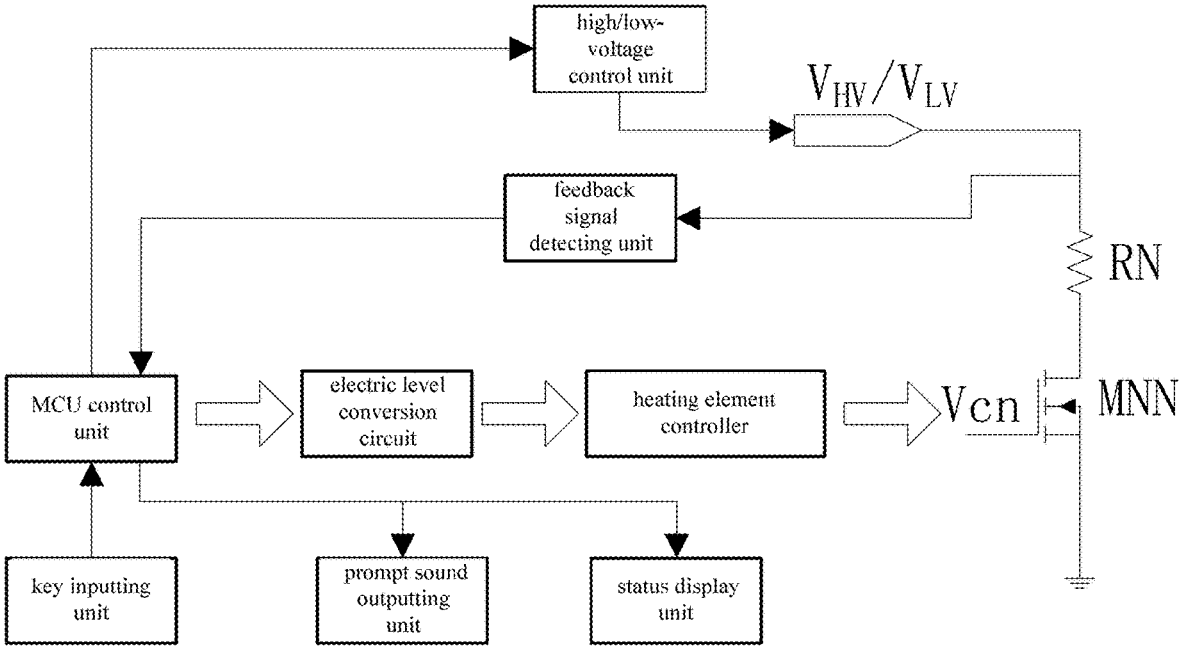
FIG. 12 is a schematic view of an equipment of burning out an ink cartridge in an embodiment.

In one embodiment, the reused ink cartridge can be made by a burning out device of ink cartridge as shown in FIG. 12. The burning out device can include an MCU control unit (Microcontroller Unit), a key inputting unit, a prompt sound outputting unit, a status display unit, an electric level conversion circuit, a feedback signal detecting unit, and a high/low-voltage control unit.

The MCU control unit is a control chip of the burning out device. The key inputting unit can be an external input device for prompting whether the ink cartridge is installed in a right place. The prompt sound outputting unit is configured to output a prompt sound, indicating whether the operation of burning out is successful. The status display unit is used to display the starting, success and failure information of the operation of burning out. The electric level conversion circuit is configured to convert the low-voltage signal of the MCU control unit into a 9V or 15V control signal required for the ink cartridge. The heating element control unit is configured for selecting the target heating element inside the ink cartridge. The feedback detecting unit is configured to convert the feedback signal of the heating element into a recognizable signal for the MCU control unit. The high-/low-voltage control unit is configured to output a low-voltage and small current signal when reading the state of the heating elements, and to output a high-voltage and high-current signal to burn out the heating elements. A heating element inside the ink cartridge is labelled as RN, and the control tube that controls the conduction of the RN is labelled as MNN.

Figure 13:
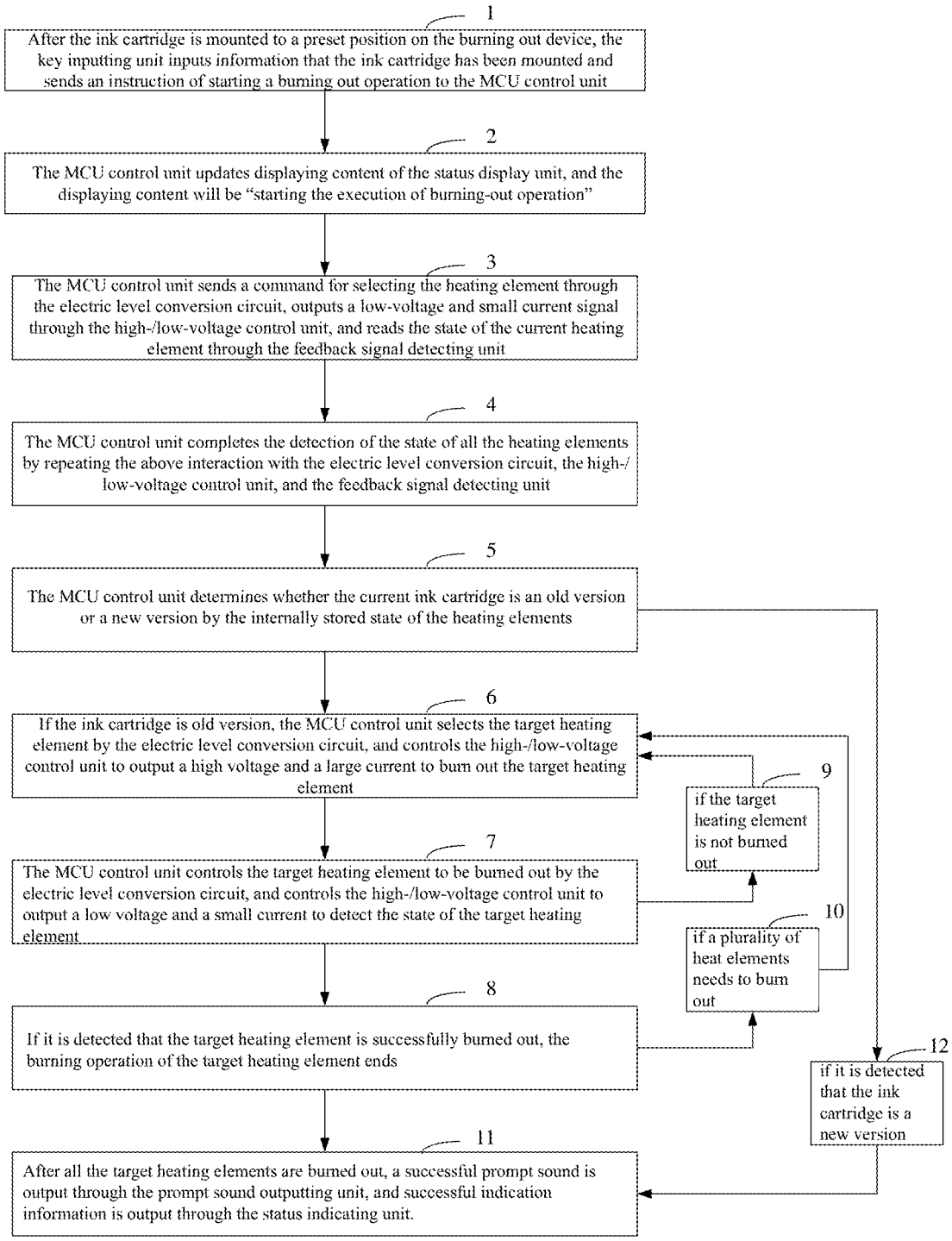
FIG. 13 is a flow chart of a burning out device of ink cartridge in an embodiment.

Referring to FIG. 13, the process of the burning out device of the ink cartridge is as follows:

1. After the ink cartridge is mounted to a preset position on the burning out device, the key inputting unit inputs information that the ink cartridge has been mounted in the preset position and sends an instruction of starting a burning out operation to the MCU control unit.

2. The MCU control unit updates displaying content of the status display unit, and the displaying content will be "starting the execution of burning-out operation".

3. The MCU control unit sends a command for selecting the heating element through the electric level conversion circuit, outputs a low-voltage and small current signal through the high-/low-voltage control unit, and reads the state of the current heating element through the feedback signal detecting unit.

4. The MCU control unit completes the detection of the state of all the heating elements by repeating the above interaction with the electric level conversion circuit, the high-/low-voltage control unit, and the feedback signal detecting unit.

5. The MCU control unit determines whether the current ink cartridge is an old version or a new version by the internally stored state of the heating elements.

6. If the ink cartridge is an old version, the MCU control unit selects the target heating element by the electric level conversion circuit, and controls the high-/low-voltage control unit to output a high voltage and a large current to burn out the target heating element.

7. The MCU control unit controls the target heating element to be burned out by the electric level conversion circuit, and controls the high/low voltage control unit to output a low voltage and a small current to detect the state of the target heating element.

8. If it is detected that the target heating element is successfully burned out, the burning operation of the target heating element ends.

9. If it is detected that the target heating element is not burned out, the steps of 6 and 7 are repeated until the target heating element is burned out.

10. If it is necessary to perform a burning out operation of a plurality of heat elements, the steps 6-9 are repeated.

11. After all the target heating elements are burned out, a successful prompt sound is output through the prompt sound outputting unit, and successful indication information is output through the status indicating unit.

12. In the step 6, if it is detected that the ink cartridge is a new version, step 11 is directly performed.

The technical features of the above-described embodiments may be combined in any combination. For the sake of brevity of description, all possible combinations of the technical features in the above embodiments are not described. However, as long as there is no contradiction between the combinations of these technical features, all should be considered as within the scope of this disclosure.

One skilled in the art can understand that all or part of the process in the above embodiments can be completed by a computer program to instruct related hardware, and the program can be stored in a non-volatile computer readable storage medium. In the embodiment, the program may be stored in a storage medium of the computer system and executed by at least one processor in the computer system to implement steps of an embodiment including a method of reusing the ink cartridge as described. The storage medium may be a magnetic disk, an optical disk, a read-only memory (ROM), or a random access memory (RAM).

The above-described embodiments are merely illustrative of several embodiments of the present disclosure, and the description thereof is relatively specific and detailed, but is not to be construed as limiting the scope of the disclosure. It should be noted that a number of variations and modifications may be made by those skilled in the art without departing from the spirit and scope of the disclosure. Therefore, the scope of the disclosure should be determined by the appended claims.

We claim:

1. A method for reusing an ink cartridge, the method comprising:

detecting each of a plurality of heating elements in the ink cartridge, wherein the plurality of heating elements is located on both sides of nozzles of the ink cartridge;

determining one of the plurality of heating elements, which is not used with a printer, as a target heating element according to a detecting result; and burning out the target heating element.

2. The method for reusing the ink cartridge of claim 1, wherein the burning out the target heating element comprises:

turning on an end of the target heating element; and applying a driving signal to another end of the target heating element.

3. The method for reusing the ink cartridge of claim 2, wherein the turning on the end of the target heating element comprises:

sending a target signal to the ink cartridge, and turning on a control tube of the ink cartridge according to the target signal the applying the driving signal to the other end of the target heating element comprises:

applying a high-voltage pulse signal to the other end of the target heating element.

4. The method for reusing the ink cartridge of claim 2, wherein after the applying the driving signal to the other end of the target heating element, the method further comprises:

applying a first detecting signal to the other end of the target heating element, receiving a first feedback signal of the other end of the target heating element, and judging if the target heating element is burned out or not according to the first feedback signal;

if the target heating element is not burned out, repeating the step of applying the driving signal to the other end of the target heating element.

5. The method for reusing the ink cartridge of claim 4, wherein the first feedback signal comprises an electric potential of drive end of the target heating element, the judging if the target heating element is burned out or not according to the first feedback signal comprises:

if the electric potential of drive end of the target heating element is the same as an electric potential of the first detecting signal, judging that the target heating element is burned out.

6. The method for reusing the ink cartridge of claim 3, wherein the detecting result comprises state information of each of the plurality of heating elements, the determining the one of the plurality of heating elements as the target heating element according to the detecting result comprises:

obtaining state information of preset heating elements, wherein the preset heating elements matches with the printer; and determining the one of the plurality of heating elements as the target heating element according to the state information of each of the plurality of heating elements and the state information of preset heating elements.

7. The method for reusing the ink cartridge of claim 6, wherein the state information of each of the plurality of heating elements is detected by:

turning on the end of one of the plurality of heating elements, and applying a second detecting signal to the other end of the one of the plurality of heating elements; and obtaining a second feedback signal of the one of the plurality of heating elements, and obtaining the state information of each of the plurality of heating elements according to the second feedback signal.

8. The method for reusing the ink cartridge of claim 7, wherein the turning on one end of the one of the plurality of heating elements comprises:

sending a selected signal to the ink cartridge, turning on the control tube of the ink cartridge according to the selected signal in order to turn on the end of the one of the plurality of heating elements;

the applying a second detecting signal to the other end of the one of the plurality of heating elements comprises:

applying a preset low-voltage signal to the other end of the one of the plurality of heating elements.

9. A non-transitory, machine readable storage medium having stored thereon instructions for performing a method, comprising machine executable code which when executed by at least one processor, causes the processor to:

detect each of a plurality of heating elements in an ink cartridge, wherein the plurality of heating elements is located on both sides of nozzles of the ink cartridge;

determine one of the plurality of heating elements, which is not used with a printer, as a target heating element according to a detecting result; and burn out the target heating element.

10. A reused ink cartridge, comprising a plurality of heating elements, wherein the plurality of heating elements is located on both sides of nozzles of the reused ink cartridge, and the plurality of heating elements comprise a target heating element not matched with a printer, wherein the target heating element is burned out.

11. The reused ink cartridge of claim 10, further comprising a plurality of control tubes and a heating element controller connected to the plurality of control tubes, wherein each of the plurality of heating elements is correspondingly connected to one of the plurality of control tubes, and the heating element controller is configured for receiving a target signal and turning on one of the plurality of control tubes correspondingly, in order to turn on one end of the target heating element.

* * * * *